US005186613A

United States Patent [19]

Kotlarek et al.

[11] Patent Number: 5,186,613

[45] Date of Patent: Feb. 16, 1993

[54] REVERSE PHASE AND HIGH DISCHARGE TEMPERATURE PROTECTION IN A SCROLL COMPRESSOR

[75] Inventors: Peter A. Kotlarek, Onalaska, Wis.; John R. Moilanen, La Crescent, Minn.; Mark W. Harrison, Onalaska, Wis.

[73] Assignee: American Standard Inc., New York, N.Y.

[21] Appl. No.: 811,777

[22] Filed: Dec. 20, 1991

[51] Int. Cl.[5] ..... F04B 49/00; F04B 49/08

[52] U.S. Cl. ..... 417/291; 417/292

[58] Field of Search ..... 417/291, 292, 300

[56] References Cited

U.S. PATENT DOCUMENTS

| | | | |
|---|---|---|---|
| 4,560,330 | 12/1985 | Murayama et al. | 418/55 |
| 4,820,130 | 4/1989 | Eber et al. | 417/32 |
| 4,828,462 | 5/1989 | McBurnett | 417/291 |
| 4,840,545 | 6/1989 | Moilanen | 417/301 |
| 4,934,910 | 6/1990 | Utter | 418/55 |
| 5,090,880 | 2/1992 | Mashimo | 417/310 |

FOREIGN PATENT DOCUMENTS

| | | | |
|---|---|---|---|
| 0218792 | 9/1986 | Japan | 417/292 |
| 0221696 | 9/1990 | Japan | 417/292 |

*Primary Examiner*—Richard A. Bertsch
*Assistant Examiner*—Alfred Basichas
*Attorney, Agent, or Firm*—William J. Beres; William O'Driscoll; Peter D. Ferguson

[57] ABSTRACT

A low side scroll compressor is protected from both the potentially damaging effects of improper electrical hookup and the development of high discharge temperatures by the disposition of a valve member in a passage which communicates between the suction pressure portion and a discharge pressure portion of the compressor. The valve operates to permit the flow of gas from the suction to the discharge pressure portion of the compressor through a protective passage when the compressor is caused to run backwards due to miswiring so as to avert damage to the scroll members. The valve permits the flow of gas from the discharge to the suction pressure portion of the compressor through the protective passage when the temperature of the discharge gas produced by the compressor is caused to exceed a predetermined temperature. The resulting flow causes the compressor motor to de-energize.

23 Claims, 4 Drawing Sheets

REVERSE PHASE AND HIGH DISCHARGE TEMPERATURE PROTECTION IN A SCROLL COMPRESSOR

TECHNICAL FIELD

This invention relates generally to the protection of scroll compressors from damage due to the existence of abnormal operating conditions. More specifically, this invention relates to protective apparatus within a low side scroll compressor which selectively permits the internal flow of refrigerant gas between the compressor's suction and discharge pressure portions to prevent damage to the scroll members due to improper electrical hookup and the effects of abnormally high discharge temperatures.

BACKGROUND OF THE INVENTION

Hermetic compressors, including those of the scroll type, are of a high or a low side type. A high side compressor is one in which the motor is disposed in the discharge or high pressure portion of the compressor shell. A low side compressor is one in which the motor is disposed in the suction or low pressure portion of the hermetic shell.

A common problem in hermetic rotary compressors, including those of the scroll type, is the tendency of compressed refrigerant gas to flow back from the discharge pressure portion of the compressor shell, through the compression mechanism and back to the suction side of the shell upon compressor shutdown. This backflow is as a result of the natural tendency of the system within which the compressor is employed to equalize its internal pressure when the compressor is de-energized. Such backflow, if not prevented, can cause the high speed reverse rotation of the compression mechanism and can lead to potentially serious compressor damage.

The prevention of such backflow upon compressor shutdown is typically accomplished by the disposition of a discharge check valve downstream of the aperture through which gas is discharged from the compressor's compression mechanism. The discharge check valve is closed by the initial backflow of refrigerant gas through the compressor which begins immediately upon compressor shutdown. The closing of the discharge check valve may be assisted or accelerated by a biasing member such as a spring.

In scroll compressors having compression mechanisms which are protected from gas-driven reverse rotation by apparatus such as a discharge check valve, a problem arises when the compressor is electrically connected in an improper manner. Such improper electrical connection can cause the motor to run in a direction reverse from which it is intended to run. This problem is recognized in U.S. Pat. Nos. 4,820,130 and 4,840,545, both of which are assigned to the assignee of the present invention.

Briefly, when a scroll compressor having a discharge check valve is miswired so that it is caused to run backwards, the pockets defined between the scroll wraps, instead of moving radially inward and decreasing in volume, move radially outward and expand in volume in a pumping action. In effect, the scroll device functions as a gas expander or pump as opposed to a compressor.

The expansion of the pockets defined by the scroll members under such circumstances causes low and even negative pressures to develop within the pockets because the discharge check valve, being closed, gives the mechanism no source of gas to pump from. As a result, the scroll members are drawn tightly together which can eventually result, to the extent the compressor motor continues to run backwards, in severe damage and possibly destruction of the compressor.

Still another difficulty and potential source for damage in scroll compressors is the development of high discharge gas temperatures in operation. Such high discharge temperatures can result from, among other things, the operation of the compressor in a system where pressure ratios develop that are outside of the compressor's normal operating range. Such high discharge gas temperatures can cause thermal growth within the compressor, and, in particular, thermal growth of the scroll wraps. The thermal expansion of the scroll wraps can lead to high wrap tip contact loads and the galling of the wrap tips.

Compressor protection with respect to the development of high discharge temperatures has historically involved the disposition of a temperature sensor on a discharge line leading from the compressor's hermetic shell or the disposition of an internally mounted temperature sensor closely proximate to the location at which discharge gas issues from between the scroll wraps into the discharge portion of the compressor shell. The former arrangement can be inadequate because the externally mounted sensor, which is remote from the critical scroll wrap location, may not sense the existence of high discharge temperatures sufficiently early to prevent damage to the scroll members.

The latter arrangement, employing an internally mounted temperature sensor, while faster acting than arrangements employing externally mounted sensors, requires the mounting of the sensor in the discharge pressure portion of the compressor's hermetic shell. As a result, in low side compressors the leads of a sensor mounted in the discharge pressure portion of the shell must be routed out of the hermetic shell or at least out of the discharge pressure portion of the shell in order for the signal produced by the sensor to be used to shut down the compressor's motor.

The need continues to exist to protect hermetic scroll compressors of the low side type from the damage which can result from their improper electrical hookup or from the occurrence of high discharge temperatures, while eliminating the need to position a temperature sensor in the discharge portion of the compressor shell and the need to route sensor leads through or out of the shell's discharge pressure portion.

SUMMARY OF THE INVENTION

With the above background in mind, it is an object of the present invention to prevent the damage which can result from the improper electrical hookup of a scroll compressor motor and the reverse rotation of the driven scroll member which results therefrom.

It is another object of the present invention to provide protection for a scroll compressor against the damage which can result from the development of high compressor discharge temperatures.

It is a further object of the present invention to provide protection for a scroll compressor against the damage which can result from the reverse rotation of the driven scroll member and from the development of high discharge temperatures through the action of a combined compressor protection arrangement.

It is a still further object of the present invention to provide scroll compressor protection against the damaging effects of reverse direction scroll rotation and abnormally high discharge temperatures in a manner which eliminates the need for disposing a discharge temperature sensor internal of the discharge pressure portion of the compressor's shell and the need to route sensor leads out of the discharge portion of the compressor.

These and other objects of the present invention will be appreciated when the attached Drawing Figures and the Description of the Preferred Embodiment found hereinbelow are considered.

The present invention is directed to an arrangement which selectively permits the flow of refrigerant gas (i.) in a first direction within a scroll compressor in response to the development of high compressor discharge temperatures and (ii.) in the opposite direction within the compressor in response to the reverse direction rotation of the driven scroll member but which (iii.) prevents any such flow under normal compressor operating conditions. Such permitted internal refrigerant flow during other than normal operating conditions is through an interruptable passage which within the shell of the compressor that communicates between the suction pressure portion of the shell and a portion of the compressor through which discharge gas flows during normal operation.

The controlled internal refrigerant flow permitted by the protective arrangement prevents compressor damage which would otherwise result from the development of high discharge temperatures or the development of sub-suction pressures between the scroll members such as can result from reverse direction compressor motor rotation. When the circumstances of high discharge temperature or sub-suction pressures between the scroll members do not exist, refrigerant flow through the internal passage is prevented.

The invention contemplates the disposition of a protective valve member in a passage which communicates between the suction portion of the compressor shell and a location downstream of the aperture through which compressed gas is discharged from between the scroll members is normal operation. The valve member is, however, located upstream of the discharge check valve which operates to cut off the backflow of compressed gas through the compressor upon normal compressor shutdown.

The protective valve member is preferably a free-floating bimetal valve, unconnected to any other compressor element, which is disposed in an enlarged portion of the internal refrigerant passage and which is lifted by the flow of gas from the suction pressure portion of the compressor through the passage which occurs when a pressure gradient develops across the valve. Such a pressure gradient across the valve will develop under circumstances which include the reverse direction rotation of the driven scroll member and the operation of the compressor as an expander as explained above.

Such protective refrigerant flow through the passage will be from the suction portion of the compressor shell, through the passage in which the bimetal valve is disposed and back to a pocket defined by the scroll members. This will result in general pressure equalization between the pockets defined by the scroll members and the suction pressure portion of the compressor. The compressor, acting as an expander, will pump from suction back to suction so long as the improper reverse direction motor rotation continues. In net effect, the compression apparatus is short-circuited under such circumstances by the lifting of the protective valve member in a manner which prevents damage to the scroll members.

Upon the occurrence of abnormally high discharge temperatures, the bimetal valve, which is normally exposed to compressor discharge gas through the passage in which it is disposed, diaphragms in a manner which permits the venting of discharge gas around it and through the passage back to suction. By positioning the passage, where it opens into the suction pressure portion of the compressor, to be near a thermally actuated motor protection device, the motor protection device can be quickly actuated to shut the compressor down under high discharge temperature condition. The compressor is therefore protected from high discharge temperatures in a manner which does not require the use of a temperature sensor disposed in the discharge portion of the shell or the routing of sensor leads out of that portion of the compressor.

DESCRIPTION OF THE PREFERRED EMBODIMENT

Figure 1:
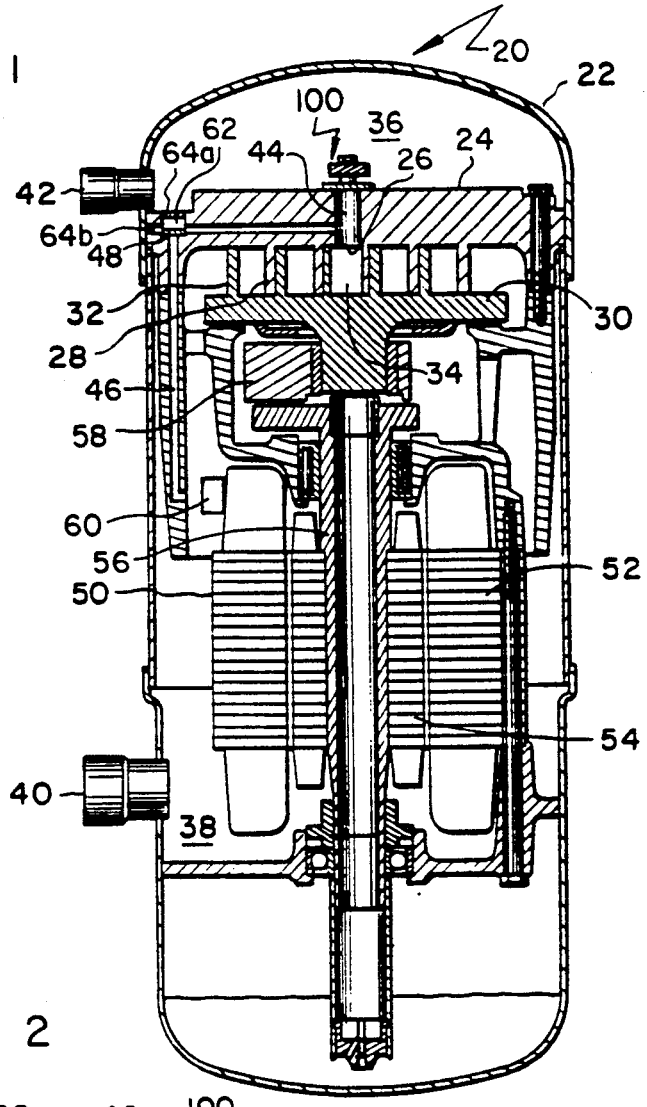
FIG. 1 shows a cross-sectional view of a low-side scroll compressor which embodies the present invention.
Figure 2:
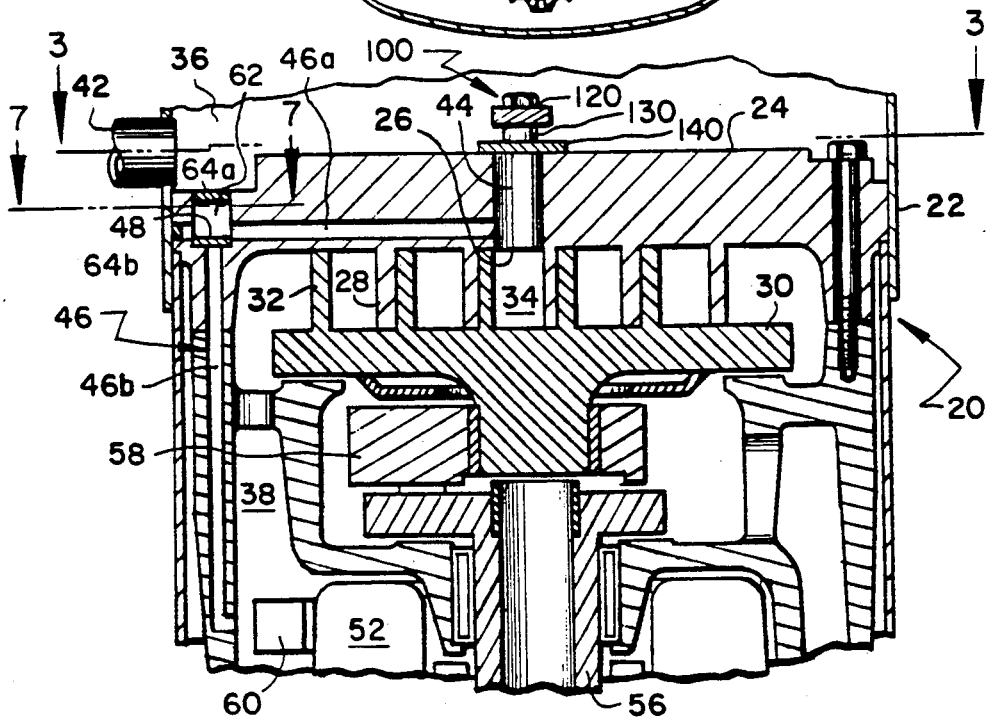
FIG. 2 is an enlarged partial cross section of the upper portion of the compressor illustrated in FIG. 1 with the compressor in its de-energized state.
Figure 3:
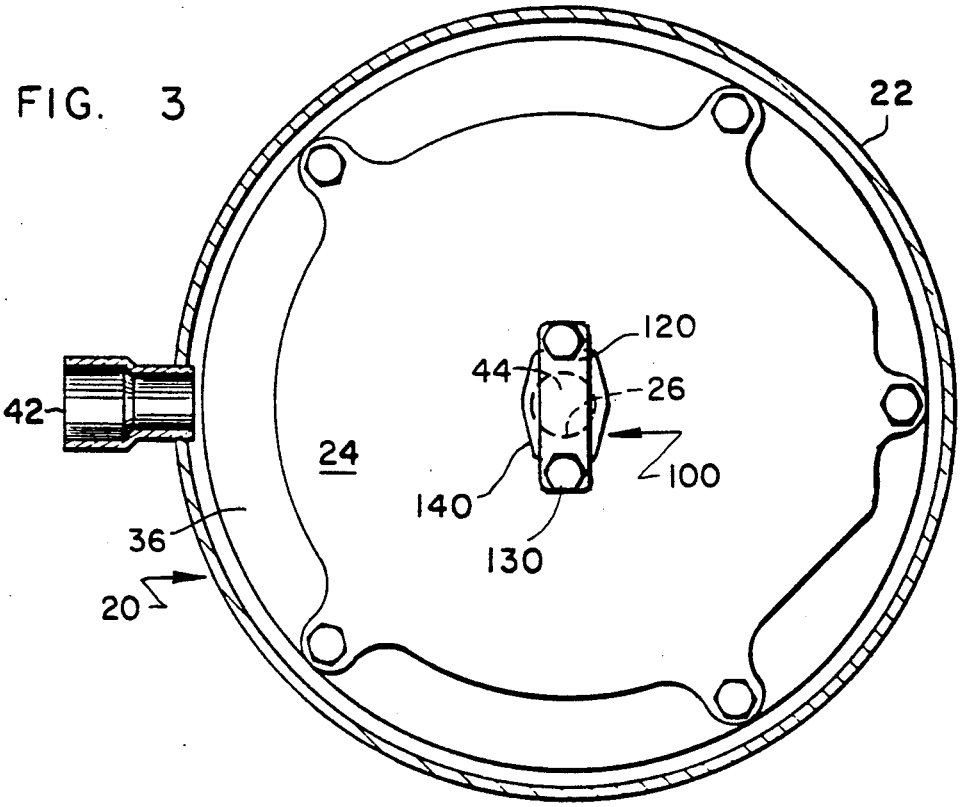
FIG. 3 is a view taken along line 3—3 of FIG. 2.

Referring first to FIGS. 1, 2 and 3, compressor 20 has a hermetic shell 22, in which a fixed scroll member 24 is disposed. Fixed scroll member 24 defines a discharge aperture 26 and has an involute wrap 28 extending from it. An orbiting scroll member 30 is likewise disposed in shell 22 and likewise has an extending involute wrap 32 which is disposed in interleaving engagement with the involute wrap 28 of fixed scroll member 24.

The operating principles of scroll compressors are well known and described, such as, for instance, in U.S. Pat. No. 4,934,910 which is assigned to the assignee of the present invention and which is incorporated herein by reference. These general operating principles will therefore not be discussed in great detail other than as necessary to describe the present invention.

Scroll members 24 and 30 and their interleaved involute wraps 28 and 32 cooperate to define a plurality of pockets therebetween. The volume of the pockets decrease as they move in a radially inward direction toward discharge aperture 26 when compressor 20 is in normal operation. The pockets and their movement are created by the relative orbital motion of the scroll members. Discharge pocket 34 is the radially innermost pocket defined by the scroll members and is in flow communication with discharge aperture 26 of the fixed scroll member.

Fixed scroll member 24 serves to divide hermetic shell 22 into a discharge pressure portion 36 and a suction pressure portion 38. It should be understood that the division of hermetic shell 22 into a discharge pressure portion 36 and suction pressure portion 38 can be accomplished by means other than the use of fixed scroll member 24 such as by the use of an independent barrier or seal member.

A suction port 40 is provided to permit gas at suction pressure to enter suction pressure portion 38 of hermetic shell 22. Suction gas enters the radially outermost pocket defined by the scroll members, which is cyclically formed and closed by the orbital movement of the orbiting scroll member with respect to the fixed scroll member. A discharge port 42 is provided in shell 22 to permit the discharge of compressed gas from the discharge portion 36 of the compressor.

Communicating between discharge aperture 26 and the discharge portion 36 of shell 22 is a discharge passage 44 through which compressed gas is communicated from discharge pocket 34, through aperture 26 and to shell discharge portion 36 when the compressor is in normal operation. A passage 46, in which a valve member 48 is disposed and which is comprised of passage portions **46*a* and 46*b*, communicates between discharge passage 44 and shell suction pressure portion 38** as will more thoroughly be described below.

Compressor 20 is driven by an electric motor 50 which is disposed in the suction pressure portion 38 of shell 22 and is therefore a low side compressor. Motor 50 includes a stator 52 and rotor 54. A drive shaft 56 connects motor rotor 54 and orbiting scroll member 28 through a swing like mechanism 58. Motor 50 includes a thermally actuated line break device 60 associated with stator 52. The line break device is disposed adjacent the opening of passage 46 into suction pressure portion 38 of the compressor shell.

Although compressor 20 is illustrated as including a swing like mechanism, it should be understood that the present invention is equally applicable to scroll compressors which do not make use of swing like apparatus including scroll compressors of the fixed throw type. It must also be understood that although device 60 is preferably a thermally actuated line break device which is integral with the compressor motor, other thermally actuated devices are suitable for use and are within the scope of the present invention.

Compressor 20 includes means, operable when the pressure in discharge pressure portion 36 of shell 22 exceeds the pressure in discharge pocket 34 (such as upon compressor shutdown), for preventing the backflow of refrigerant gas from discharge pressure portion of the shell back through passage 44 and into discharge pocket 34 between the scroll members. As illustrated, such means are a discharge check valve assembly 100 which is disposed atop fixed scroll member 24.

Discharging check valve assembly 100 is comprised of a stop member 120 which is fixedly disposed between guide posts 130 as is best illustrated in FIG. 3. Valve assembly 100 includes a free-floating valve element 140 which operates between a closed position in which it seats over and closes passage 44 from discharge portion 36 and an open position in which the flow of discharge gas through passage 44 lifts the valve element upward so that it seats against stop member 120.

Figure 4:
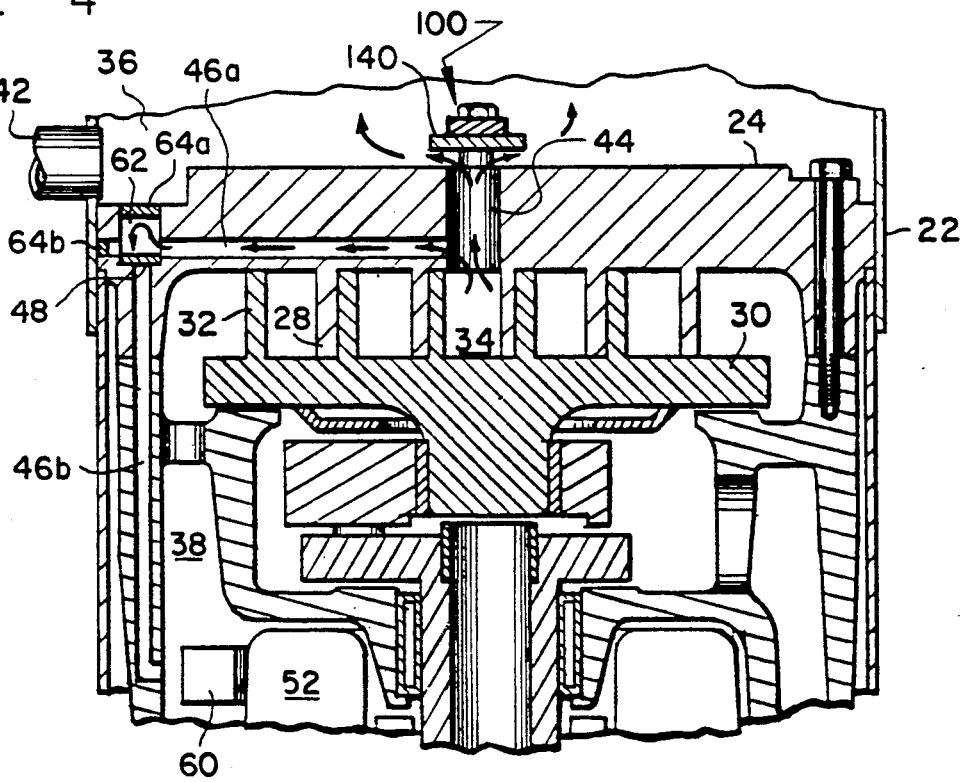
FIG. 4 is a reproduction of FIG. 2 showing the disposition of the compressor discharge valve and gas flow path through the fixed scroll member when the compressor is in normal operation.

When compressor 20 is shut down and pressures within shell 22 are equalized, valve element 140 rests over discharge passage 44, as is illustrated in FIG. 2, and is maintained there by force of gravity. When compressor 22 starts and discharge gas begins to flow through passage 44 from pocket 34, the flow of the compressed gas lifts valve element 140 and maintains it in the open position resting against stop member 120 as is illustrated in FIG. 4.

Upon compressor shutdown, when orbiting scroll member 30 ceases to be driven by motor 50 and the scroll members cease to interact to compress gas between them, gas will immediately begin to flow back out of the discharge pressure portion of the shell, into passage 44 and through the scroll members in an attempt by the system in which the compressor is employed to equalize its internal pressure. In doing so, the backflowing gas will immediately carry valve element 140 downward so as to close off passage 44 from discharge portion 36 which prevents any further such backflow. The elevated pressure in discharge portion 36, so long as it exists, will assist in maintaining valve element 140 seated. Pressure across the valve element and within the compressor will eventually equalize as pressures equalize across the system in which the compressor is employed.

The near immediate closure of the discharge valve assembly prevents the continued rapid backflow of gas from discharge portion 36 upon compressor shutdown and, more importantly, prevents such continued backflow to the scroll members from the system in which compressor 20 is employed. It will be appreciated that the system will contain a relatively much larger volume of discharge pressure gas at such time as the compressor shuts down than will be found in the discharge portion of the compressor shell. If orbiting scroll member 28 were permitted to be driven in the reverse direction by such backflow for too long a period of time, damage to the compressor would result as has been discussed above.

Because valve element 140 will be in its closed position whenever the compressor is at rest, including those instances where the compressor has not yet been initially wired or has been electrically disconnected, it will be appreciated that if motor 50 is initially or subsequently miswired such that orbiting scroll member 28 is driven in a direction opposite from that which is intended, the pockets defined by the scroll member, including discharge pocket 34 will be caused to expand and move radially outward. As a result, compressor 20 will function, in effect, as an expander.

In doing so, the scroll members will act against the closed discharge check valve assembly 100 to that pressure in the compression pockets, including discharge pocket 34, is pulled down and becomes less than suction pressure. The pressure may, in fact, approach vacuum because closed valve element 140 prevents the flow of gas from the discharge pressure portion of the compressor and eliminates a souce of gas from which the miswired apparatus can pump. Under such conditions, the tips of the wraps of the scroll members are drawn into exceedingly high frictional contact with the opposing scroll member and severe compressor damage can occur.

As has also been mentioned, the compressor can be damaged by exceedingly high discharge temperatures which can occur, for instance, due to operation of the compressor at pressure ratios outside of its normal operating range. Such temperatures can cause thermal growth of the scroll members, particularly in their wraps, with the result that contact loads on the tips of the scroll members become exceedingly high.

Figure 5:
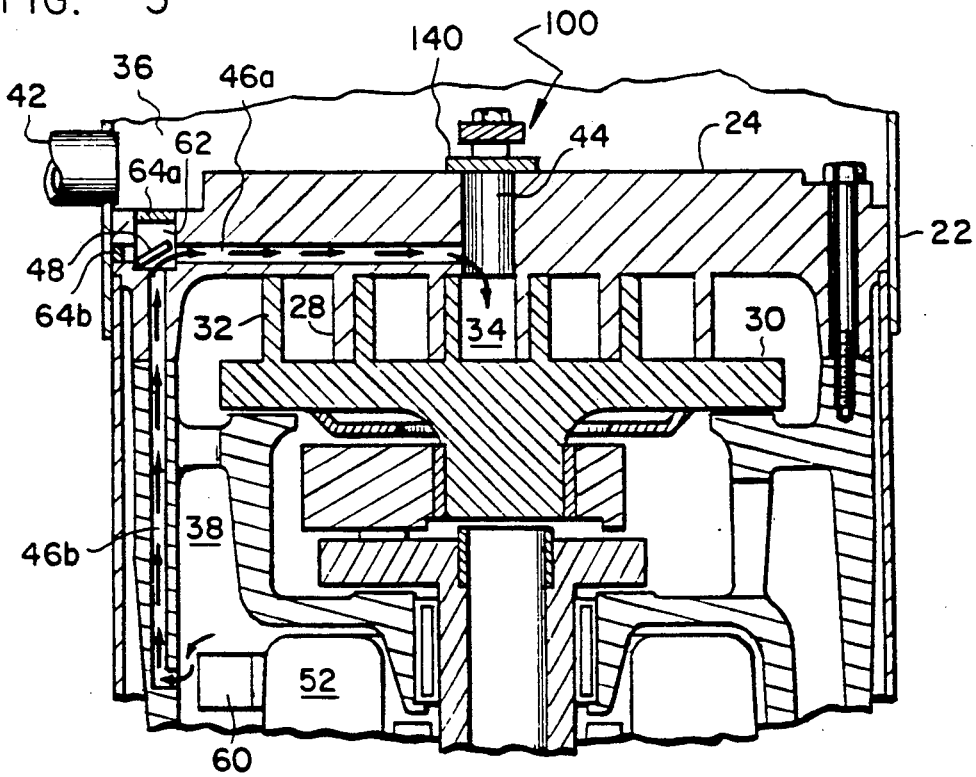
FIG. 5 is a reproduction of FIG. 2 illustrating the operation of the protective arrangement of the present invention and the gas flow therethrough when the compressor is miswired so as to run in the reverse direction or when sub-suction pressures are otherwise caused to develop in the pockets defined by the scroll members.
Figure 6:
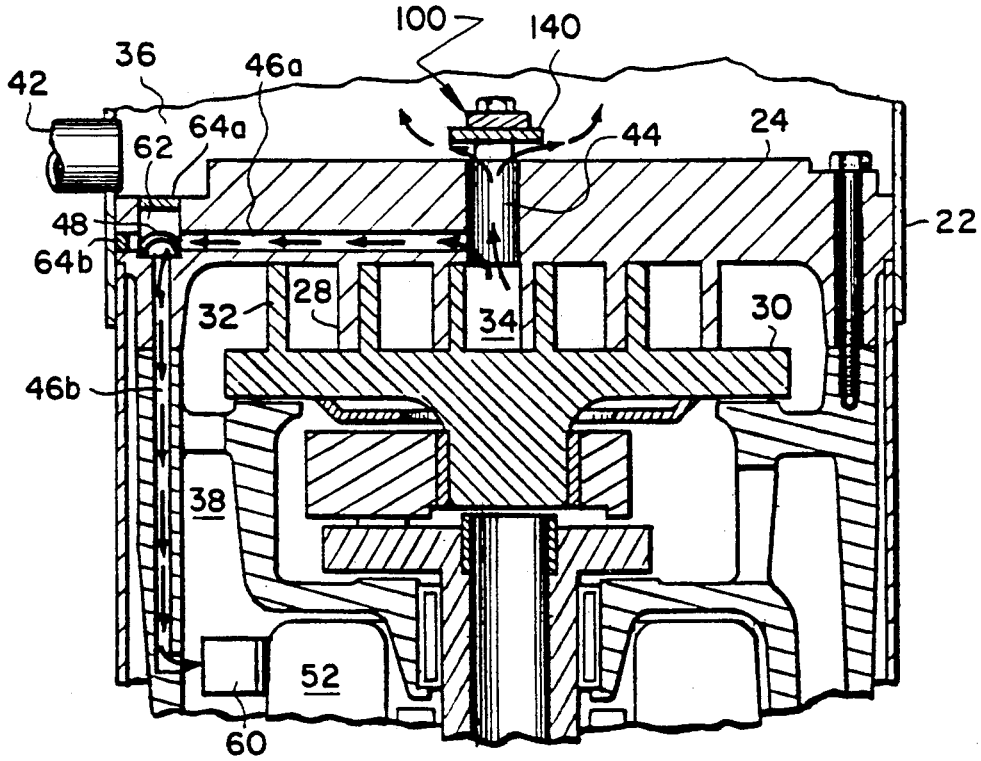
FIG. 6 is a reproduction of FIG. 4 illustrating the operation of the protective arrangement of the present invention and the gas flow therethrough when abnormally high discharge temperatures occur while the compressor is in operation.

Referring now to FIGS. 5 and 6, the operation of the compressor protective apparatus of the present invention will be discussed in view of the above described abnormal operating conditions. Referring first to FIG. 5, operation of the protective apparatus of the present invention to prevent compressor damage due to the development of sub-suction pressures between the scroll members, such as might occur upon the reverse rotation of the orbiting scroll member, will be considered.

As has previously been indicated, in the event that motor 50 of compressor 20 is miswired so that it runs backward, compressor 20 will function as an expander. The expansion of the compression pockets, including discharge pocket 34, causes a reduction in pressure in those pockets such that pressures less than suction pressure will occur within the pockets in a very short time.

Since discharge pocket 34 is open to discharge passage 44 which, under such circumstances, is closed off from the discharge pressure portion of the compressor by the seating of valve element 140 over passage 44, the development of a sub-suction pressure within discharge pocket 34 will result in the development of sub-suction pressures both in discharge passage 44 and in the portion 46*a* of passage 46. Passage portion 46*a* is on the discharge pressure side of valve member 48 and opens into passage 44. Valve member 48 is an otherwise free-floating element within a closed chamber 62 and is unconnected to any other compressor element. Chamber 62 in this embodiment is closed such as by plugs 64*a* and 64*b* and can be characterized as an enlarged portion of passage 62.

The development of a sub-suction pressure in passage portion 46*a* will cause a pressure gradient to occur across valve member 48 since the portion 46*b* of passage 46, which is located on the opposite side of valve member 48, is open to the suction pressure portion of the compressor. It will be appreciated that when discharge pressure exists in discharge passage 44, such pressure will be communicated through passage portion 46*a* into chamber 62 and will maintain valve member 48 seated so as to prevent the flow of gas from passage portion 46*a* into passage portion 46*b*. However, if the compressor is miswired such that the orbiting scroll member is driven in a reverse direction or if sub-section pressures should otherwise develop in the compression chambers between the scroll members, the suction pressure found in passage portion 46*b* will exceed the reduced pressure found in passage portion 46*a*. This condition causes valve member 48 to be lifted by the resulting flow of suction pressure gas through passage 46 from the suction pressure portion of the compressor into discharge passage 44 and into discharge chamber 34.

Therefore, upon the occurrence of even a slight pressure differential across free-floating valve member 48, as would be indicative of the development of sub-suction pressure in the discharge pocket defined by the scroll wraps, suction pressures gas will quickly begin to flow through passage 46 and into discharge pocket 34 to prevent the development of excessive contact loads on the scroll wrap tips. At such time as pressure greater than suction pressure comes to exist in discharge pocket 34 and discharge passage 44, such as by the proper wiring of the compressor and the resulting compression of gas between the scroll members, valve member 48 will be caused to seat within chamber 62 by discharge pressure gas and will prevent the flow of gas through passage 46 under what amounts of a normal operating condition.

Referring now to FIGS. 4 and 6, during normal compressor operation, as is illustrated in FIG. 4, compressed gas at discharge pressure passes out of discharge chamber 34, through discharge passage 44 and effects the lifting of valve element 140 of the discharge check valve assembly 100. Additionally, that same gas acts on protective valve member 48 to keep it seated within chamber 62 over passage portion 46*a* thereby preventing the flow of discharge pressure gas through passage 46 back to the suction pressure portion of the compressor shell. Under circumstances where the temperature of the compressed gas being discharged from discharge chamber 34 becomes abnormally high, however, the exposure of valve member 48 within chamber 62 to such high discharge gas temperatures will cause valve member 48 to become heated.

Figure 7:
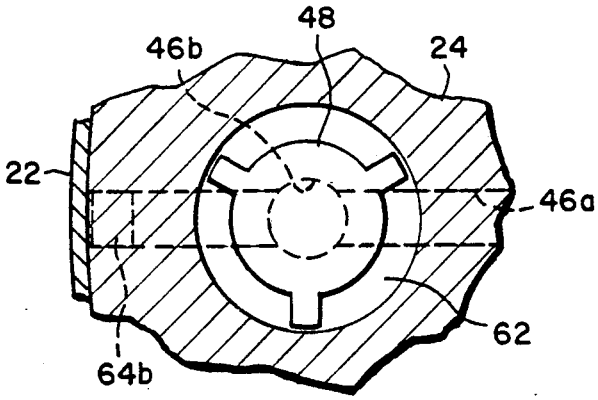
FIG. 7 is a view taken along the line 7—7 in FIG. 2.
Figure 8:
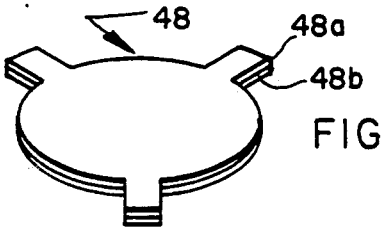
FIG. 8 is a perspective view of the valve portion of the protective mechanism.

Referring concurrently now to FIGS. 6, 7 and 8, it will be appreciated that valve member 48 is a bimetal valve comprised of two layers 48*a* and 48*b* of dissimilar metals the thermal expansion rates of which are dissimilar. The metals selected for the fabrication of valve member 48 are selected in accordance with their thermal expansion characteristics so that when the valve member is heated the differing expansion rates of the dissimilar metals will cause the valve to diaphragm.

Valve member 48, as is illustrated, has a generally circular portion the facial area of which is greater than the cross sectional area of passage portion 46*b*. The valve member preferably has three legs such that when it diaphragms due to being exposed to gas which is at an abnormally high temperature, the legs of the valve member are maintained in contact with the interior of chamber 62. The spaces created between the legs of the diaphragmed valve member under such circumstances permit the passage of the abnormally hot discharge pressure gas between them and into passage portion 46*b*. The gas then flows into suction pressure portion 38 of the compressor shell. It will be appreciated that given the direction of gas flow described under these circumstances the flow of gas, along with the force of gravity, will maintain the legs of valve member 48 in contact with an interior surface of chamber 62 as illustrated.

Passage portion 46*b* opens into suction pressure portion 38 of compressor shell 22 at a location proximate to motor stator 52 and the location on motor stator 52 where thermally actuated line break device 60 is disposed. Under the circumstances of the development of abnormally high discharge temperatures, the discharge gas will flow through passage 46, past diaphragmed valve member 48, and will issue into the suction pressure portion of the compressor. The hot discharge gas issuing from passage portion 46*b* will cause thermally actuated line break device 60 to be heated to a point where electrical continuity within the motor will be interrupted and the motor will be de-energized. The thermal characteristics of valve member 48 and line break 60 are selected to ensure their operation and the shutdown of the motor before discharge temperatures reach levels which can potentially cause damage to the compressor.

It is to be noted that the protective arrangement of the present invention, as discussed above, eliminates the need to dispose a discharge temperature sensor in the discharge pressure portion of the compressor in close proximity to discharge chamber 34 or to the discharge check valve assembly. It also eliminates the need to penetrate shell 22 or fixed scroll member 24 with sensor wiring.

It is also to be noted, as will be discussed further, that the protective system of the present invention is equally applicable to compressors which do not have an internal discharge check valve assembly such as where a discharge check valve is disposed downstream of the discharge pressure portion of the compressor shell. If the discharge check valve assembly is located downstream of the discharge pressure portion of the compressor shell it will be appreciated that protective passage 46, which is net effect is a passage between a discharge pressure and a suction pressure portion of the compressor, can be located anywhere within the compressor so long as it opens both into the discharge and suction pressure portions of the compressor shell.

Figure 9:
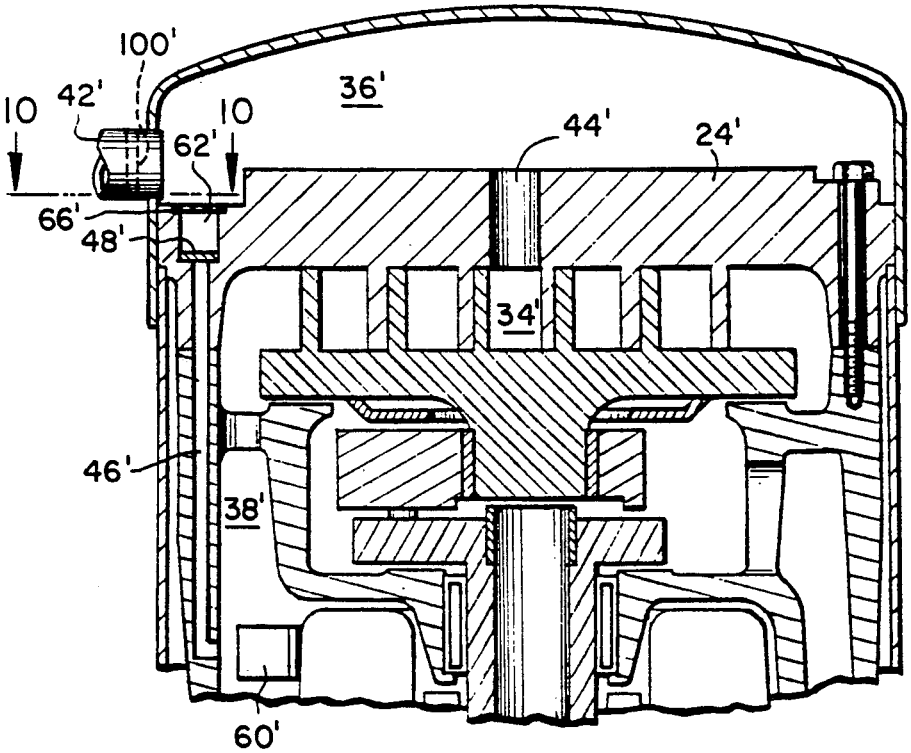
FIGS. 9 and 10 are illustrative of an alternative embodiment of the present invention.
Figure 10:
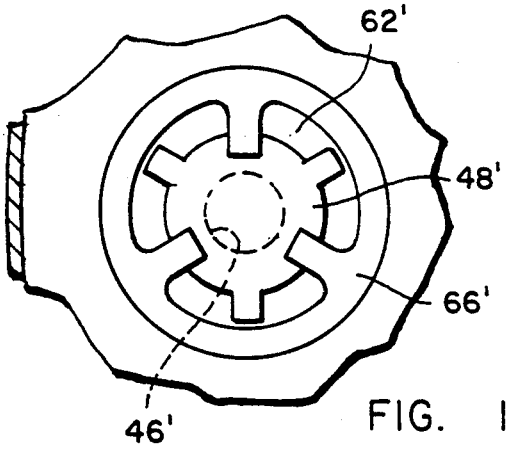

One such embodiment is illustrated in FIG. 9 in which passage 46' is illustrated as an essentially straight passage through the fixed scroll member 24' and wherein the discharge check valve 100' is schematically illustrated as being disposed in discharge port element 42'. FIG. 10 illustrates that protective bimetal valve member 48' is disposed and confined, in a free-floating manner, in a chamber 62'. Chamber 62', in this embodiment, is open directly to the discharge pressure portion 36' of the shell and therethrough to passage 44' and pocket 34'. Valve member 48' is retained in chamber 62' by a retainer insert 66'. The compressor protecting apparatus of this embodiment operates on the same principles as the apparatus disclosed in FIGS. 1-8 including the opening of passage 46' into suction pressure portion 38' adjacent thermally actuated line break device 60'.

As will be appreciated, there are other alternative arrangements and equivalents which are suggested by and fall within the scope of the invention described herein. Therefore, the present invention is not to be limited other than in accordance with the language of the claims which follow.

What is claimed is:

1. Scroll gas compression apparatus comprising:

a shell through which a gas flows when said compression apparatus is in operation, said shell defining a suction pressure portion and a discharge pressure portion;

a first scroll member disposed in said shell, said first scroll member having an involute wrap and defining a discharge aperture, said discharge aperture being in flow communication with said discharge pressure portion of said shell;

a second scroll member disposed in said shell, said second scroll member having an involute wrap in interleaving engagement with the involute wrap of said first scroll member, the involute wraps of said first and said second scroll members cooperating to define a plurality of pockets including a discharge pocket which is in flow communication with said discharge aperture of said first scroll member and out of which compressed gas is discharged when said apparatus is in normal operation; and means for permitting selective bi-directional gas flow between said discharge pocket and said suction pressure portion of said shell, said gas flow occurring in a first direction when gas pressure in said discharge pocket is less than gas pressure in said suction pressure portion of said shell and said flow being in a direction opposite said first direction when discharge gas temperature exceeds a predetermined temperature.

2. The gas compression apparatus according to claim 1 wherein said means for permitting selective bi-directional flow includes means for defining a passage internal of said shell communicating between said suction pressure portion and said discharge pocket.

3. The gas compression apparatus according to claim 2 wherein said means for permitting the selective bi-directional flow of said gas includes a valve member, said valve member being actuated so as to permit the flow of gas through said passage (i.) by the development of a pressure in said discharge pocket which is less than the pressure in said suction pressure portion of said shell and (ii.) upon the occurrence of discharge gas temperatures which exceed said predetermined temperature.

4. The gas compression apparatus according to claim 3 wherein said valve member is a thermally responsive bimetal valve member.

5. The gas compression apparatus according to claim 4 wherein said valve is disposed entirely within said passage and is unconnected to any other element of said compression apparatus.

6. The gas compression apparatus according to claim 5 further comprising a motor for driving one of said first and said second scroll members, said motor being disposed in said suction pressure portion of said shell.

7. The gas compression apparatus according to claim 6 wherein said passage opens into said suction pressure portion of said shell, proximate the location of a thermally actuated protective device, which, when exposed to temperatures exceeding said predetermined temperature causes said motor to de-energize.

8. The gas compression apparatus according to claim 7 further comprising discharge check valve means for preventing the backflow of gas from said discharge pressure portion of said shell to said discharge pressure pocket when the pressure in said discharge pressure pocket is less than the pressure in said discharge pressure portion of said shell and wherein said valve is a bimetal valve which is free-floating within said passage.

9. The gas compression apparatus according to claim 8 wherein said passage communicates with said discharge pocket through an opening which is located between said discharge pocket and said discharge check valve means.

10. A gas compression apparatus according to claim 9 wherein said passage is defined by said fixed scroll member.

11. The gas compression apparatus according to claim 9 wherein said thermally actuated protective device is in a line break which is integral to said motor.

12. Apparatus for compressing a gas comprising:

a hermetic shell defining a suction pressure portion and a discharge pressure portion;

means for preventing the backflow of gas through said discharge pressure potion of said shell;

an orbiting scroll member disposed in said shell, said orbiting scroll member having an involute wrap;

a fixed scroll member disposed in said shell, said fixed scroll member having an involute wrap and defining a discharge aperture, said discharge aperture being in flow communication with said discharge pressure portion of said shell, the involute of said fixed scroll member being in interleaving engagement with the involute wrap of said orbiting scroll member so as to cooperatively define a plurality of pockets therebetween including a discharge pocket, said discharge pocket being in flow communication with said discharge aperture, said fixed scroll member further defining a passage, said passage opening into said suction pressure portion of said shell and into a location within said apparatus between said discharge pocket and said means for preventing backflow; and means for controlling gas flow through said passage in said fixed scroll member, said means for controlling flow (i.) permitting the flow of gas from said suction pressure portion of said shell to said discharge pocket when the pressure in said discharge pocket is less than the pressure in said suction pressure portion and (ii.) permitting the flow of gas from said discharge pocket to said suction pressure portion when the temperature of said gas exceeds a predetermined temperature.

13. The apparatus according to claim 12 wherein said means for controlling gas flow comprises a bimetal valve member, said valve member being disposed in said passage.

14. The apparatus according to claim 13 wherein said bimetal valve member is free-floating within said passage so as to be physically unconnected to any other element of said compression apparatus, said valve responding to discharge gas temperatures which exceed said predetermined temperature by changing shape to permit the flow of gas from said discharge pocket to said suction pressure portion of said apparatus.

15. The apparatus according to claim 14 further comprising a motor disposed in said suction pressure portion of said shell, said motor having a thermally actuated line break device, said line break device being positioned adjacent the location where said passage opens into said suction pressure portion of said shell so that when discharge gas of a temperature exceeding said predetermined temperature passes through said passage and into said suction pressure portion of said shell said line break device is actuated thereby to cause said motor to de-energize.

16. The apparatus according to claim 15 wherein said valve member is maintained seated in said passage by discharge pressure gas when said compression apparatus is in operation so as to prevent the flow of gas through said passage when discharge gas temperatures are less than said predetermined temperature and when the pressure in said discharge pocket exceeds the pressure in said suction pressure portion of the said shell.

17. The apparatus according to claim 16 wherein said valve is caused to be unseated by the flow of gas through said passage from said suction pressure portion of said shell to said discharge pocket which occurs when a pressure gradient develops across said valve where said pressure gradient results from the existence of a pressure in said discharge pocket which is less than the pressure in said suction pressure portion of said shell.

18. The apparatus according to claim 17 wherein said means for preventing the backflow of gas is disposed downstream of said discharge pressure portion of said shell.

19. A method for protecting a scroll compressor against damage upon the occurrence of reverse direction motor rotation or high discharge temperatures comprising the steps of:

defining a passage in said compressor, said passage communicating between a suction pressure portion of said compressor and a portion of said compressor through which discharge gas flows when said compressor is in normal operation; and controlling flow through said passage so that:

(i) gas is permitted to flow through said passage from said suction pressure portion to said portion of said compressor through which discharge gas normally flows when the pressure in said suction pressure portion exceeds the pressure in said portion of said compressor through which discharge gas normally flows;

(ii) gas is permitted to flow through said passage from said portion of said compressor through which discharge gas normally flows to said suction pressure portion of said compressor when the temperature of said gas exceeds a predetermined temperature; and (iii) gas is prevented from flowing through said passage when said discharge temperature is less than said predetermined temperature and when the pressure in said portion of said compressor through which discharge gas normally flows exceeds the pressure in said suction pressure portion.

20. The method according to claim 19 further comprising the step of disposing a thermally responsive valve in said passage.

21. The method according to claim 20 wherein said scroll compressor includes a motor disposed in said suction pressure portion of said shell, said method further comprising the step of disposing a thermally actuated motor protective device adjacent the location where said passage opens into said suction pressure portion of said shell so that when discharge gas exceeding said predetermined temperature is permitted to flow through said passage, said thermally actuated motor protection device is actuated by said discharge gas and causes said motor to shutdown.

22. The method according to claim 21 further comprising the step of fabricating said valve from a bimetal so that said valve responds to temperatures in excess of said predetermined temperature by changing shape, the change of shape of said valve opening said passage to flow when discharge gas temperatures exceed said predetermined temperature.

23. The method according to claim 22 wherein said fabricating step includes the step of sizing said valve so that upon its being disposed in said passage said valve is free to move within a predetermined portion of said passage and is unconnected to said compressor, other than by contact therewith.

* * * * *